US005424813A

United States Patent [19]

Schlueter, Jr. et al.

[11] Patent Number: 5,424,813

[45] Date of Patent: Jun. 13, 1995

[54] APPARATUS AND METHOD FOR IMPROVED BLOTTER ROLLER PERMEABILITY

[75] Inventors: Edward L. Schlueter, Jr., Rochester; Lucille M. Sharf, Pittsford; Joseph Mammino, Penfield; Jerome P. Chasko, Williamson; Christine J. Tarnawskyj, Webster, all of N.Y.

[73] Assignee: Xerox Corporation, Stamford, Conn.

[21] Appl. No.: 247,737

[22] Filed: May 23, 1994

[51] Int. Cl.[6] ..... G03G 21/00

[52] U.S. Cl. ..... 355/256; 118/109; 118/661; 492/28

[58] Field of Search ..... 355/256, 296, 307; 118/109, 652, 659–662; 430/117–119, 125; 492/28, 48, 49, 51, 53

[56] References Cited

U.S. PATENT DOCUMENTS

| | | | |
|---|---|---|---|
| 3,694,071 | 9/1972 | Touchette . | |
| 3,955,533 | 5/1976 | Smith et al. | 118/637 |
| 4,142,480 | 3/1979 | Schwandt et al. | 118/661 |
| 4,258,115 | 3/1981 | Magome et al. | 430/125 |
| 4,263,391 | 4/1981 | Saito et al. | 430/125 |
| 4,286,039 | 8/1981 | Landa et al. | 430/119 |
| 4,299,902 | 11/1981 | Soma et al. | 430/125 |
| 4,339,858 | 7/1982 | Peterson . | |
| 4,392,742 | 7/1983 | Landa | 355/15 |
| 4,607,947 | 8/1986 | Ensing . | |
| 4,985,733 | 1/1991 | Kurotori et al. | 355/282 |
| 5,028,964 | 7/1991 | Landa et al. | 355/273 |

*Primary Examiner*—R. L. Moses
*Attorney, Agent, or Firm*—Leslie A. Weise

[57] ABSTRACT

A roller for increasing the rate of permeability of liquid carrier from an image formed from a liquid developer comprised of toner particles and liquid carrier. Perforations formed through the skin covering of the blotter roller provide high quality transfer of an image having maximum toner particles and minimal liquid carrier to a final copy sheet, at an increased process speed.

32 Claims, 5 Drawing Sheets

APPARATUS AND METHOD FOR IMPROVED BLOTTER ROLLER PERMEABILITY

BACKGROUND OF THE INVENTION

This invention relates to an electrophotographic printing machine and more particularly to a method and apparatus for removing toner dispersant from an image formed from a liquid developer.

A typical electrostatographic printing machine employs an imaging member that is exposed to an image to be printed. Exposure of the imaging member records an electrostatic latent image on it corresponding to the informational areas contained within the image to be printed. The latent image is developed by bringing a developer material into contact therewith. The developed image recorded on the photoconductive member is transferred to a copy sheet such as paper, either directly or via an intermediate transport member. The developed image on the copy sheet is generally subjected to heat and/or pressure to permanently fuse it thereto.

Two types of developer materials are typically employed in electrostatographic printing machines. One type of developer material is known as dry developer material and comprises toner particles or carrier granules having toner particles adhering triboelectrically thereto. Another type of developer material is a liquid material comprising a liquid carrier or dispersant having toner particles dispersed therein.

Liquid developer typically contains about 2 percent by weight of fine solid particulate toner material dispersed in the liquid carrier. The liquid carrier is typically a hydrocarbon. In the developing process, the developed image on the photoreceptor contains about 12 weight percent of particulate toner in liquid hydrocarbon carrier. To improve the quality of transfer of the developed image to a receiving member or copy sheet, the image should be conditioned, i.e. percent solids in liquid should be increased by removing liquid carrier from the image while preventing toner particles from departing the image. Depending on the particular liquid carrier structural composition and its respective properties during the image formation process, e.g. vapor pressure rate, evaporation rate and volatility, the percentage of solids in the liquid should be increased to in the range of 25 to 75 percent. Increase in percent solids may be achieved by removing excess liquid carrier with a porous blotter in the form of a roller or belt (hereinafter collectively referred to as "roller"), typically positioned with respect to the photoconductive member retaining the latent image. When the developed image is transferred to an intermediate belt before final transfer to a final copy sheet, the developed image on the intermediate belt should again be blotted to further increase the percentage of toner solids, so that the amount of liquid on the final copy sheet is minimized, and a well defined, high quality image is produced.

Polymers such as various polyurethanes, olefins, tetrafluoroethylene, and various elastomers, may be processed into open cell poromeric foam material appropriate for use in blotter roller applications, using the teachings, for example, in U.S. Pat. Nos. 3,696,180; 3,729,536; 3,860,680; 3,968,292; 4,157,424, and other methods known in the art. Conductive fillers, organic and inorganic, ionic or electronic may be added to regulate the poromeric material conductivity.

These open cell poromeric forming processes generally produce a top and bottom skin layer. This skin covering generally tends to have pores of a smaller size and a lesser quantity than the open cell inner foam material, and serves as a structural support and protective covering for the inner foam layer. The skin covering must have a porosity sufficient to absorb liquid carrier from the developed image, however, should have a smooth, glossy surface texture so that toner particles from the developed image are prevented from departing the image and embedding into the irregularities found on a more textured blotter roller skin surface. It is important to prevent toner particles from entering the blotter roller, as the pores of the roller become blocked and the rate of absorption of the liquid carrier from the developed image is slowed. Image quality is impaired when toner particles depart therefrom, and frequent cleaning and/or replacement of the roller is necessitated. In addition to a smooth surface on the blotter roller skin covering, a bias applied to the blotter roller having the same polarity as the toner particles of the developed image presents a repelling force between the toner and the roller, further preventing toner particles from entering the blotter roller.

A shortcoming of this type of blotter roller, however, is that the skin covering tends to retard fluid flow through the poromeric material, even in systems having a vacuum assist for removal of the liquid from the roller. Therefore, blotter rollers are often unable to achieve the desired toner solid weight percentage at the required process speed for a high volume production color printer. Process speed and/or image quality have been restricted by prior art blotting devices used in liquid developing systems. This shortcoming is even more apparent due to the increased tendency to use liquid carriers that are less volatile, for environmental, health and safety reasons. Less volatile liquid carriers have a decreased vapor pressure rate, and thereby give off less offensive odors and expose less vapor into the atmosphere during the image forming process. Pollution and potential health risks to individuals working near the machine are thereby reduced. However, due to the lower evaporation rates of these liquid carriers, there is provided yet an increased need for a system with an increased capacity for liquid carrier absorption from the developed image.

The following references may be relevant to various aspects of the present invention.

U.S. Pat. No. 3,955,533 to Smith et al. discloses a squeegee roller system for removing excess developer liquid from the developer-image-bearing photoconductive surface of a drum or the like. The squeegee roller has a covering of a predetermined hardness which is biased with a predetermined force against the moving surface carrying a developed image to cause excess developer to flow into a receptacle.

U.S. Pat. No. 4,263,391 to Saito et al. discloses an elastic rotary member used in the developing process, composed of an electroconductive rigid core member, an electroconductive porous elastic member, and a liquid permeable insulating flexible member composed of a netting or a material having perforations. The outer member is designed to allow the elastic rotary member, having liquid developer material absorbed therethrough, to squeeze out such developer material for deposit onto the latent image carrying member when the elastic rotary member is compressed thereagainst, and then to recover excess liquid developer upon recovery of the elastic rotary member from the compressed state after leaving contact with the latent image carrying member.

U.S. Pat. No. 4,258,115 to Magome et al. similarly describes a developing elastic roller member having a rigid shaft and an elastic foam member surrounding the shaft, composed of a netting or apertured sleeve. The elastic roller supplies developing liquid from the roller to an electrostatic image bearing surface when urged against such surface. The elastic roller then collects excess developing liquid after having been in contact with the image bearing surface, and finally deposits the excess developing liquid in a liquid pool after the elastic roller is urged against a refresh roller.

U.S. Pat. No. 4,299,902 to Soma et al. discloses an image forming process which utilizes an elastic roller or belt having a flexible outer member composed of a netting or a material having perforations. The elastic roller or belt applies liquid developer to a latent image and then absorbs excess liquid developer. Part of the roller or belt is kept in a liquid developer reservoir.

U.S. Pat. No. 4,985,733 to Kurotori et al. describes an image fixing unit for a wet-type electrophotographic copying machine comprises a blotter roller which absorbs a carrier liquid component, such as Isopar, contained in a developer deposited imagewise by an image-transfer charger on a transfer sheet. The blotter roller is comprised of a porous covering material such as a nonwoven fabric or cotton and an elastic material such as silicone rubber. The transfer sheet is transported into an image fixing unit wherein a pressure-application roller is in contact with a heat-application roller, such that a toner image formed on the transfer sheet is thermally fixed thereto, while the transfer sheet passes through a nip between the heat-application roller and the pressure-application roller. The blotter roller is in contact with a back-up roller with a predetermined pressure. A cleaning pad, brush or roller may be used to clean the blotter roller of toner particles adhering thereto.

U.S. Pat. No. 4,286,039 to Landa et al discloses an image forming apparatus comprising a deformable polyurethane roller, which may be a squeegee roller or blotting roller which is biased by a potential having a sign the same as the sign of the charged toner particles in a liquid developer. The bias on the polyurethane roller is such that it prevents streaking, smearing, tailing or distortion of the developed electrostatic image and removes much of the liquid carrier of the liquid developer from the surface of the photoconductor.

U.S. Pat. No. 4,392,742 to Landa discloses a cleaning system for a liquid developer electrostatographic copier comprising a roller formed with a resilient material, such as a closed-cell elastomer, having externally exposed, internally isolated surface cells. During an operation, residual toner and excess liquid on an imaging surface is absorbed by the cleaning roller. The cleaning roller is then compressed to squeeze out liquid from the roller, leaving the roller dry.

U.S. Pat. No. 5,028,964 to Landa et al. discloses an apparatus for image transfer which comprises an intermediate transfer member and a squeegee for removing excess liquid from the toner image prior to transferring an image. The intermediate transfer member is operative for receiving the toner image therefrom and for transferring the toner image to a receiving substrate. Transfer of the image to the intermediate transfer member is aided by providing electrification of the intermediate transfer member to a voltage having the same bias as that of the charge particles.

U.S. Pat. No. 4,607,947 to Ensing et al. discloses a circulating cleaning member comprising a multiplicity of spaced-apart openings or perforations. A surface of the cleaning member collects residues or toner from a surface to be cleaned.

Copending continuing application for U.S. patent Ser. No. 08/082,141, filed Apr. 12, 1993, and having a common assignee as the present application, discloses a device and method to transfer an image to a nonabsorbing intermediate after low pressure blotting or dispersant absorption by means of a belt, whereby the belt is passed over a bias pressure roller that applies a bias to the belt to repel toner particles therefrom, and a backup roller that removes the dispersant from the belt in conjunction with a squeeze roller.

Copending application for U.S. patent Ser. No. 08/107,876, filed Aug. 8, 1993, and having a common assignee as the present application, discloses a roller for removal of excess carrier liquid from a liquid developed image, comprising a rigid porous electroconductive supportive core, a conformable microporous foam material provided around the core, and a pressure controller for providing a positive or negative pressure to the roller.

Copending continuing application for U.S. patent Ser. No. 08/017;453, filed Feb. 12, 1993, and having a common assignee as the present application, discloses a porous roller for increasing the solids content of an image formed from a liquid developer. The liquid dispersant absorbed through the roller is vacuumed out through a central cavity of the roller.

SUMMARY OF THE INVENTION

In accordance with the invention and in accordance with one aspect of the invention, there is provided an improved printing machine of the type having a surface, with an image developed with a liquid developer comprising liquid carrier and toner particles, and a roller for removing liquid carrier therefrom before transferring the developed image from the surface to a final copy sheet. The roller comprises an absorption material adapted to absorb the liquid carrier, and a covering in contact with a portion of the absorption material. The covering has a smooth surface and is substantially impervious to toner particles and pervious to liquid carrier so as to inhibit toner particles from departing the image. The covering also has a plurality of perforations therein to permit liquid carrier to pass through to the absorption material.

In accordance with another aspect of the invention, there is provided a roller for conditioning an image formed from a liquid developer including liquid carrier and toner particles. The roller comprises an absorption material adapted to absorb the liquid carrier, and a covering in contact with a portion of the absorption material. The covering has a smooth surface and is substantially impervious to toner particles and pervious to liquid carrier so as to inhibit toner particles from departing the image. The covering also has a plurality of perforations therein to permit liquid carrier to pass through to the absorption material.

In accordance with another aspect of the invention, there is provided a method of fabricating a roller for conditioning an image formed from a liquid developer comprising liquid carrier and toner particles. The method of fabricating the roller comprises the step of selecting a cover having a smooth surface that is substantially impervious to toner particles and pervious to liquid carrier so that toner particles are inhibited from departing the image. The method also includes the steps of perforating the cover with a plurality of apertures, and then placing the cover and a portion of an absorption material in contact with one another.

DETAILED DESCRIPTION OF THE DRAWINGS

Figure 1:
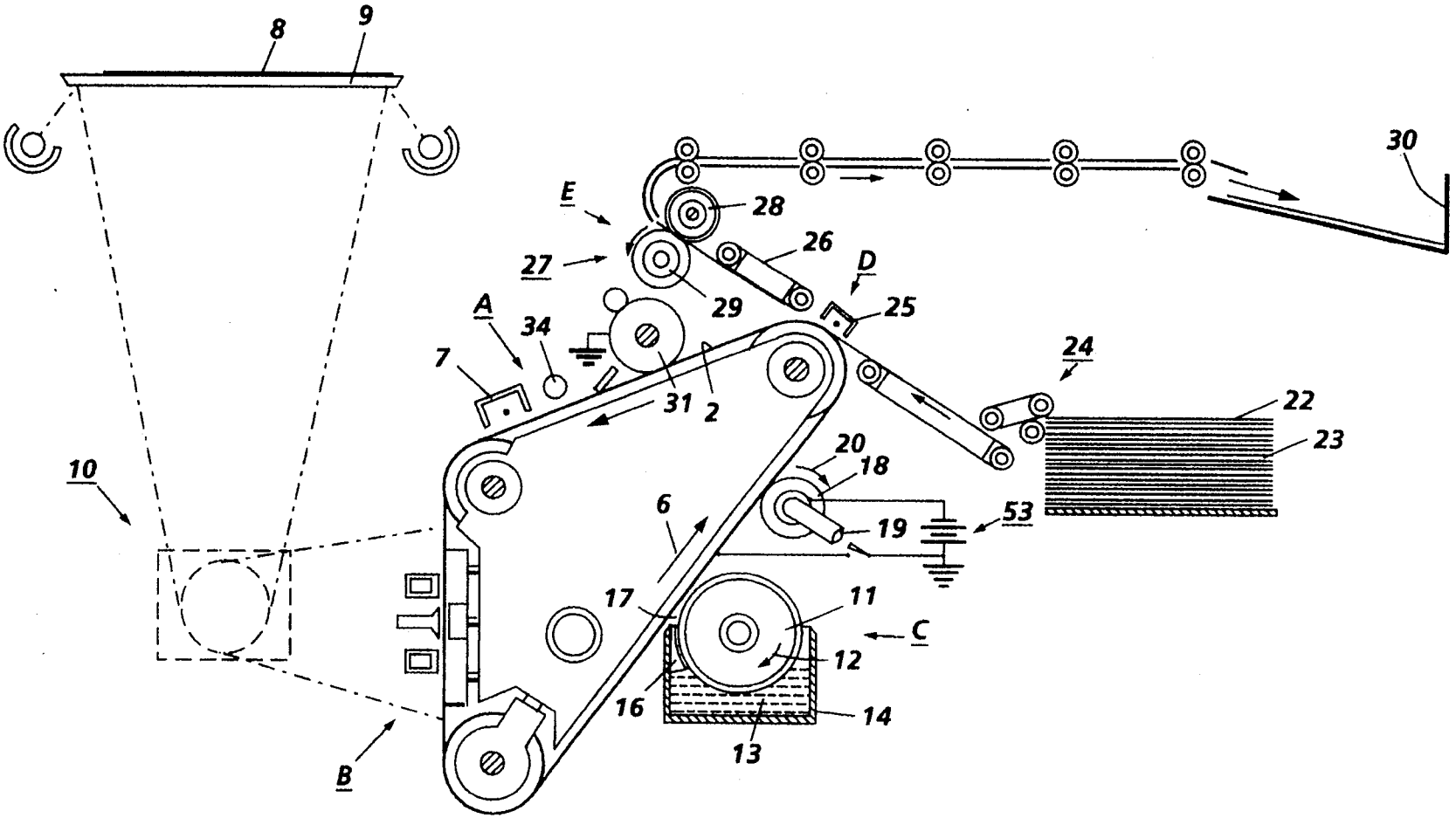
FIG. 1 is a schematic elevational view depicting an electrophotographic printing machine incorporating the features of the present invention.

In FIG. 1, printing machine 1 employs belt 2 having a photoconductive surface deposited on a conductive substrate. Initially, belt 2 passes through charging station A. At charging station A, a corona generating device 7 charges the photoconductive surface of belt 2 to a relatively high, substantially uniform potential.

After the photoconductive surface of belt 2 is charged, the charged portion is advanced to exposure station B. At exposure station B, an original document 8 is placed upon a transparent support platen 9. An illumination assembly, indicated generally by the reference numeral 10, illuminates the original document 8 on platen 9 to produce image rays corresponding to the document information areas. The image rays are projected by means of an optical system onto the charged portion of the photoconductive surface. The light image dissipates the charge in selected areas to record an electrostatic latent image on the photoconductive surface corresponding to the original document informational areas.

After the electrostatic latent image has been recorded, belt 2 advances the electrostatic latent image to development station C. At development station C, roller 11, rotating in the direction of arrow 12, advances a liquid developer material 13 from the chamber of housing 14 to development zone 17. An electrode 16 positioned before the entrance to development zone 17 is electrically biased to generate an AC field just prior to the entrance to development zone 17 so as to disperse the toner particles substantially uniformly throughout the liquid carrier. The toner particles, disseminated through the liquid carrier, pass by electrophoresis to the electrostatic latent image. The charge of the toner particles is opposite in polarity to the charge on the photoconductive surface.

By way of example, the insulating liquid carrier may be a hydrocarbon liquid although other insulating liquids may also be employed. A suitable hydrocarbon liquid is an Isopar which is a trademark of the Exxon Corporation. There is an increased tendency to use liquid carriers such as mineral oil whose structural properties are less volatile, and thereby emit a lower amount of vapor into the atmosphere, consequently emitting fewer harmful and offensive odors. The toner particles comprise a binder and a pigment. The pigment may be carbon black. However, one skilled in the art will appreciate that any suitable liquid development material may be employed.

Development station C includes porous roller 18 having perforations (shown in FIGS. 3 through 6) through the roller skin covering. Roller 18 receives the developed image on belt 2 and conditions the image by reducing fluid content while inhibiting the departure of toner particles from the image. An increase in percent solids is thereby provided to the developed image, thereby improving the quality of the developed image. Porous roller 18 will be described hereinafter with reference to FIG. 2, and in detail with reference to FIGS. 3–6. Porous roller 18 operates in conjunction with vacuum 19 for removal of liquid from the roller. A roller (not shown), in pressure against the blotter roller, may be used in conjunction with or in the place of the vacuum, to squeeze the absorbed liquid carrier from the blotter roller for deposit into a receptacle. A blotter roller of the type having a pressure roller for removal of liquid from the blotter roller is described in, for example, copending continuing application for U.S. patent Ser. No. 08/082,141, having a common assignee as the present application, the relevant portions of which are hereby incorporated herein by reference. A bias voltage 53 is applied to an electroconductive roller creating an electric field having the same sign polarity as the toner particles, thereby repelling the toner particles and inhibiting their entry into the roller 18. It will be understood that variations to the blotter roller of the present invention, such as a resistive foam layer found therein (described in further detail with reference to FIG. 3A), or a pressure roller used thereagainst, may accompany the blotter roller in conjunction with the photoconductive belt, and/or in conjunction with the intermediate transfer belt as will be described with reference to FIG. 2. Furthermore, the present invention may also find useful application where the liquid absorbing roller is in the form of a belt rotated by two or more internal rollers, whereby excess liquid carrier is absorbed through a foam layer and a skin covering having perforations formed therethrough. A belt used for collecting excess liquid from a region of liquid developed images is described in U.S. Pat. Nos. 4,299,902 and 4,258,115, the relevant portions of which are hereby incorporated by reference herein.

In operation, roller 18 rotates in direction 20 to impose against the "wet" image on belt 2. The porous body of roller 18 absorbs excess liquid from the surface of the image through the skin covering pores and perforations. Vacuum 19 located on one end of the central cavity of the roller, draws liquid that has permeated through roller 18 out through the cavity and deposits the liquid in a receptacle or some other location which will allow for either disposal or recirculation of the liquid carrier. Porous roller 18, discharged of excess liquid, continues to rotate in direction 20 to provide a continuous absorption of liquid from image on belt 2.

After the electrostatic latent image is developed, belt 2 advances the developed image to transfer station D. At transfer station D, a sheet of support material 22 is advanced from stack 23 by a sheet transport mechanism, indicated generally by the reference numeral 24. Transfer station D includes a corona generating device 25 which sprays ions onto the backside of the sheet of support material 22. This attracts the developed image from the photoconductive surface of belt 2 to copy sheet 22. After transfer, conveyor belt 26 moves the copy sheet 22 to fusing station E.

Fusing station E includes a fuser assembly indicated generally by the reference numeral 27, which permanently fuses the developed image to the copy sheet 22. Fuser assembly 27 includes a heated fuser roll 28 and back-up pressure roll 29 resiliently urged into engagement with one another to form a nip through which the copy sheet 22 passes. After fusing, the finished copy sheet 22 is discharged to output tray 30 for removal by the machine operator.

After the developed image is transferred to copy sheet 22, residual liquid developer material remains adhering to the photoconductive surface of belt 2. A cleaning roller 31 formed of any appropriate synthetic resin, is driven in a direction opposite to the direction of movement of belt 2 to scrub the photoconductive surface clean. It is understood, however, that a number of photoconductor cleaning means exist in the art, any of which would be suitable for use with the present invention. Any residual charge left on the photoconductive surface is extinguished by flooding the photoconductive surface with light from lamps 34.

Figure 2:
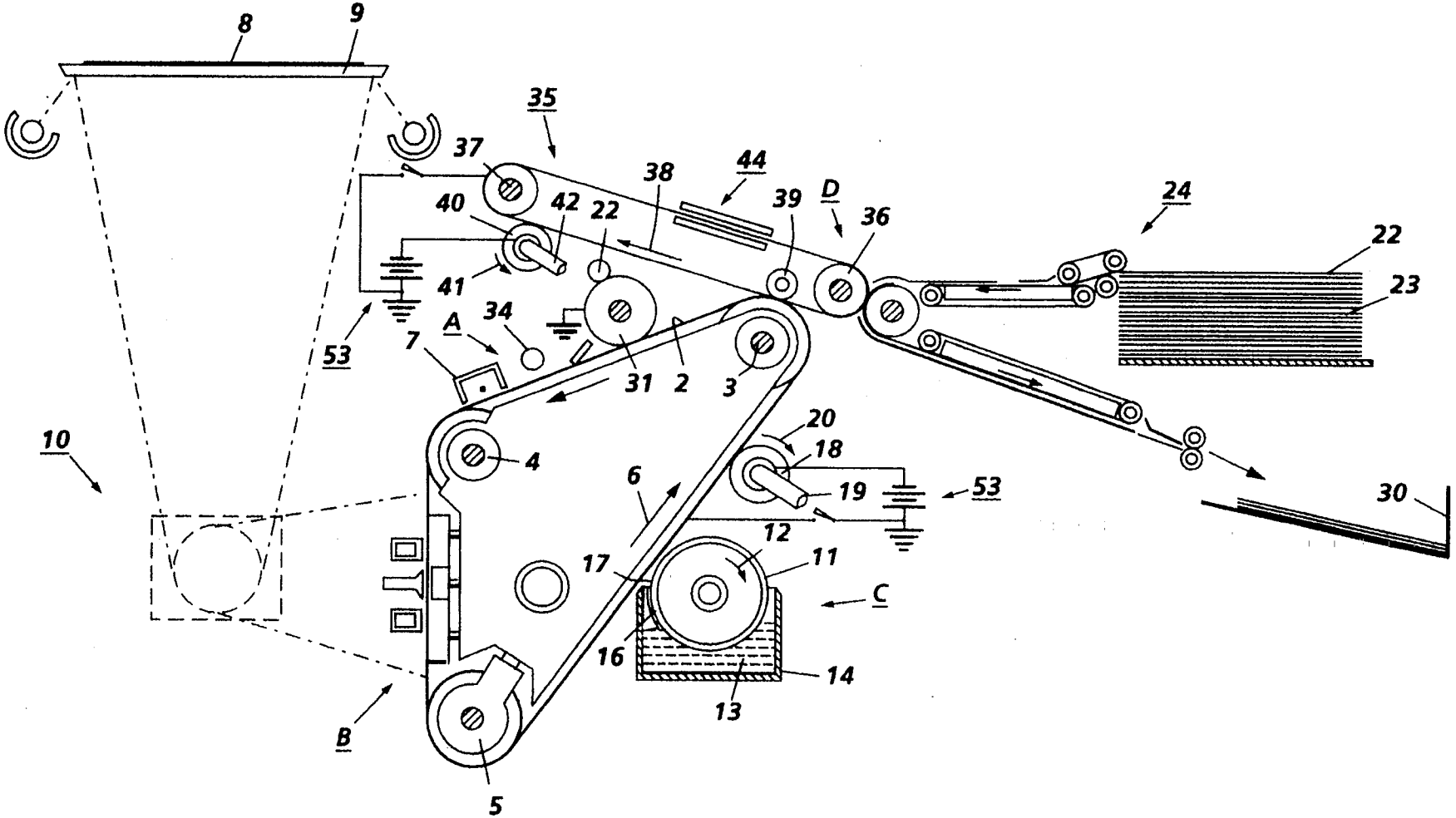
FIG. 2 is a schematic elevational view depicting a portion of another electrophotographic printing machine using an intermediate transfer belt.

FIG. 2 is a schematic representation of a portion of another printing machine which employs a moving image carrying belt, from which an image is transferred to an intermediate belt. Electrostatographic reproduction apparatus utilizing intermediate belts are described, for example, in U.S. Pat. Nos. 4,183,658; 4,684,238; 4,690,539; and 5,119,140. In FIG. 2, elements that are identical to elements in FIG. 1 are identified with like reference numerals. Referring to FIG. 2, there is shown a printing machine employing belt 2 having a photoconductive surface deposited on a conductive substrate. Roller 3 rotates and advances belt 2 in the direction of arrow 6. Belt 2 passes through charging station A where a corona generating device 7 charges the photoconductive surface of the belt 2. The charge portion of belt 2 is advanced to exposure station B where image rays from an original document are projected by means of an optical system onto the charged portion of the photoconductive surface to record an electrostatic latent image. After the electrostatic latent image has been recorded, belt 2 advances to development station C. At station C, roller 11 advances a liquid developer material 13 from the chamber of housing 14 to development zone 17. Electrode 16 positioned before the entrance to development zone 17 is electrically biased so as to disperse the toner particles substantially uniformly throughout the liquid carrier. Development station C includes porous blotter roller 18 having perforations through the skin surface. Roller 18 receives the developed image on belt 2 and conditions the image by reducing fluid content while inhibiting the departure of toner particles from the image. The percent solids in the image is thereby increased. The roller 18 operates in conjunction with vacuum 19 for removal of the liquid carrier. A bias voltage is applied to roller 18 so that a repelling force is present to prevent toner particles from leaving the photoconductive surface and entering the roller 18.

After the electrostatic latent image is developed, belt 2 advances the developed image to transfer station D. At transfer station D, the developed liquid image is electrostatically transferred to an intermediate member or belt indicated generally by the reference numeral 35. Belt 35 is entrained about spaced rollers 36 and 37. Belt 35 moves in the direction of arrow 38. Bias transfer roller 39 imposes belt 35 against belt 2 to assure image transfer to the intermediate belt 35. The porous blotter roller 40, having perforations through the roller skin covering, receives the developed image on belt 35 and reduces fluid content while preventing toner particles from departing from the image, so that percent solids of the image is further increased. The roller 40 increases percent solids to about 25 to 75 wt. % by removing excess liquid carrier in this region. Increasing solids on the intermediate belt is a particularly important function in a color image developing process utilizing multiple superimposed images of different colors. As illustrated in FIG. 2, the roller of the present invention may be used for absorbing liquid carrier at an increased rate from an image in a system having an intermediate transfer belt. Consequently, the percent particles on the image is increased, thereby increasing process speed for color imagery.

In operation, roller 40 rotates in direction 41 to impose against the image on belt 35. The porous body of roller 40 absorbs liquid from the surface of the image. The absorbed liquid permeates through roller 40 and into the inner hollow cavity 49, where a vacuum draws the liquid from the roller 40 into a liquid receptacle or some other location which will allow for either disposal or recirculation of the liquid carrier. Porous roller 40, discharged of excess liquid, continues to rotate in direction 41 to provide a continuous absorption of liquid from images on transfer belt 35. A bias voltage 53 is applied to the roller to establish a repelling force against the toner particles so that toner particles are prevented from entering the roller 40. Roller 40 may be used in conjunction with a pressure roller (not shown) to remove the liquid that has been absorbed into the roller 40.

Belt 35 then advances the developed image to transfer station D. At transfer station D, a sheet of support material 22 is advanced from stack 23 by a sheet transport mechanism, indicated generally by the reference numeral 24. The developed image from the photoconductive surface of belt 35 is attracted to copy sheet 22. After transfer, conveyor belt 45 moves the copy sheet 22 to the discharge output tray 30.

Although the apparatus shown in FIG. 2 shows only a single porous roller 40, multiple porous roller stations can be utilized in accordance with the present invention in conjunction with the transfer of multiple images to intermediate belt 35.

With reference to FIGS. 3, 4, 5 and 6, there is shown detailed structures of different embodiments of the porous blotter roller 18 of development station C of FIGS. 1 and 2, and the porous blotter roller 40 of intermediate belt 35 of FIG. 2. These rollers, with reference to FIGS. 3 through 6, are collectively referred to by the reference numeral 50, and identical elements associated with roller 50 are identified with like reference numerals.

Figure 3A:
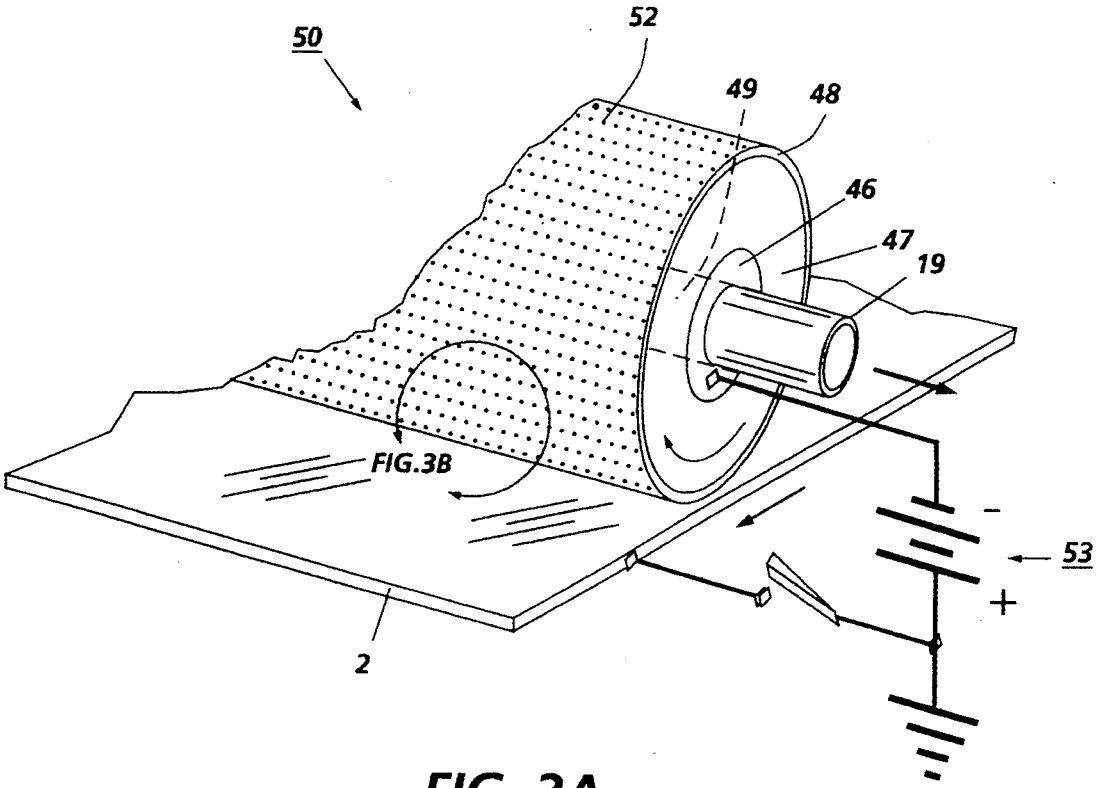
FIG. 3A is an enlarged schematic, fragmentary, perspective view of a roller used in FIG. 1 and FIG. 2.
Figure 3B:
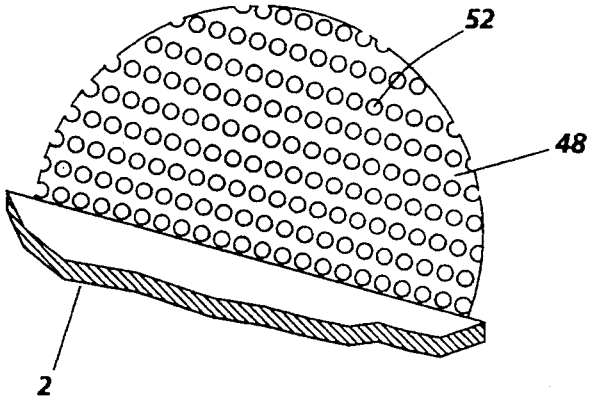
FIG. 3B is a further enlarged view of one fragment of the roller as designated in FIG. 3A.

With reference to FIGS. 3A and 3B, roller 50 comprises a rigid porous supportive core 46. In this embodiment, the core 46 is in the form of a tube, having a hollow cavity 49 throughout the length of the roller. A conformable microporous roller 47, and a skin covering 48 having a pattern of apertures or perforations 52 therethrough is provided around the core 46. A vacuum 19 draws the liquid carrier that has permeated through roller 50 into cavity 49. A high voltage bias supply 53 is connected between the belt 2 and the conductive core 46 of roller 50 for providing a bias with the same charge as that of the toner particles. The bias continuously repels the toner particles of the image on belt from the roller, while the liquid carrier is absorbed into the roller 50. A pressure controller (not shown) may be used in association with the roller to provide a positive or negative pressure to the roller.

The porous supportive core 46 can comprise a material selected from the group consisting of sintered metal, plastic and ceramic. In the instance the supportive core 46 comprises a sintered metal, exemplary metals include stainless steel, copper and bronze. Preferably the material is electroconductive, either by itself, or in combination with another conductive material, so that a bias 53 can be applied thereto, and an electrical field will result in a repelling force against the toner particles in the image. For example, the pores of the supportive core generally may be of a diameter of 2,500 microns or less.

The conformable microporous foam roller 47 is characterized by open cells forming the layer. The conformable foam roller 47 may comprise an absorbent polymeric and elastomeric material with incorporated conductive filler or dissipative filler. The conformable roller 47 is characterized by a durometer of from 10 to 90 Shore A, preferably from 20 to 60 Shore A, and has a thickness of 1.0 mils to 500 mils, preferably, a thickness of about 40 mils to 250 mils. The absorption material of the microporous roller 47 may be any suitable material, preferably a foam such as one selected from the group consisting of Polyurethane, Silicone, Fluorocarbon, Polyimide, Melamine, and rubber, such as Permair® (a microporous polyurethane material available from Porvair Ltd., England), and Tetratex® (a microporous semipermeable fluorocarbon membrane available from Tetratec Corp., Pa.). Preferably the absorbent material is resistive so that the electric field created by the bias 53 applied to the core 46 further enhances the repelling action of the toner particles from the roller 50. A suitable level of resistivity of the absorbent material is in the range of $10^{-5}$ to $10^{-11}$ ohm-cm, and is preferably in the range of $10^{-6}$ to $10^{-9}$ ohm-cm. The absorbent material must, of course, be compatible with whatever liquid carrier material is used.

The open cell pores of the absorbent material generally may be less than 1,000 microns in diameter, and preferably should be in the range of about 5 to about 300 microns, although the end product may use pore sizes outside these limits. For example, very small pores of a micron or less may be used to absorb liquid carrier from an image, however, an increased pressure would then be required to extract an equivalent amount of liquid as that of a roller having larger size pores. An exemplary blotter roller having a rigid porous electroconductive supportive core and a conformable microporous roller is described in copending application for U.S. patent Ser. No. 08/107,876, having a common assignee as the present application, the relevant portions of which are hereby incorporated herein by reference.

The vacuum system 19 assists in drawing liquid carrier through the blotter roller and into the cavity 49, where it is then removed to a collection location. The vacuum system pressure must be adjusted so as to remove only liquid carrier from the image, and not have so strong a suction force so as to also remove the toner. A vacuum pressure of 0.5 inches of water to greater than 45 inches of water, and preferably within the range of 1.0 to about 15 inches of water, has been found to be suitable to the present application. A blotter roller having a vacuum system associated therewith is described in copending continuing application for U.S. patent Ser. No. 08/017,453, having a common assignee as the present application, the relevant portions of which are hereby incorporated by reference herein.

The vacuum pressure and the speed of the roller 50 may in one preferred embodiment be selected to keep the pores of roller filled with liquid carrier. It will be appreciated that the perforations 52 formed through the blotter roller skin covering 48 of the present invention increase the rate of absorption of the liquid carrier, and therefore, the overall process speed of the image forming process, particularly when coupled with an increase in vacuum pressure. For example, a blotter roller having an absorbent foam layer made from an Endur-C polyurethane foam from the Roger's Corporation, and having a non-perforated skin covering, showed an increase in permeability of over 85 times, when the skin covering was uniformly laser perforated with holes having an average diameter of 250 microns.

In a preferred embodiment of the present invention, the skin covering 48 has a smooth, glossy surface texture with micropores which are generally of a smaller size than the toner particles of the liquid developer. A minimal surface area texture of the skin covering is preferred so that toner particles are not encouraged to leave the developed image and embed into larger sized pores and/or the irregularities of a rougher skin surface having a greater surface area texture.

The skin covering 48 has perforations 52 distributed throughout the surface area of the covering 48. Perforations formed through the skin covering increase the rate of permeability through the roller. As the absorption rate of liquid from liquid developer in prior art blotter rollers has been a barrier to achieving high image quality at high process speeds, the present invention serves to ensure a high quality image formed at an increased process speed, having a minimal amount of liquid and a maximum amount of toner present during transfer of the image to a final copy sheet.

Perforations formed through the blotter roller skin covering 48 may be circular, or may be any other geometrical shape conducive to maximum absorption of liquid carrier. The perforations may be distributed in a uniform or a non-uniform pattern throughout the surface of the skin covering. In one embodiment of the present invention and as illustrated in FIG. 3A, the circular perforations 52 through the blotter roller skin covering 48 average in size less than 25 microns in diameter, and are preferably in the range of about 1 micron to about 15 microns in diameter. The perforations are spaced apart a center to center distance ranging from 0.015 inches to 0.030 inches. It is understood that slight variations to the perforation size and spacings therebetween would provide similar results of increased permeability of the blotter roller, however, these values should not be substantially exceeded, so that the potential for toner particles to enter the blotter roller is not increased. The blotter roller should remain pervious to liquid carrier, yet substantially impervious to toner particles to inhibit the toner particles from departing the image.

The puncturing process employed to form the perforations may be of a mechanical nature, such as by a needle, knife or other sharp tool that would serve to puncture or cut through the skin covering surface. Thermal techniques such as with a laser, or an etching process through photochemical techniques, or a combination of any of the above listed techniques or their equivalents could alternatively be used to achieve the perforations of the present invention.

An exemplary perforating process is by water jet drilling, whereby pressurized water produces a pattern of perforations through the skin covering. Direct impingement of a jet of water through a patterned template or mold which would then continue to pierce through the skin covering, may be used to accomplish the perforating process. A cylindrical template, constructed of stainless steel, and having an inner and outer shell, may be used to accomplish the perforating process at a decreased manufacturing cost and at a decreased fabrication time. The desired hole pattern is preburned into the stainless steel such that the inner and outer template patterns are aligned with one another. The skin covering to be perforated is sandwiched between the inner and outer cylindrical templates and secured to a device which allows the template assembly to be rotated. The cylindrical assembly is then placed into an existing high pressure water jet system, where a fan jet nozzle is engaged to traverse the template assembly while it is rotating. The nozzle is positioned such that the high pressure fan of water blows through each hole to remove skin covering matching the predetermined hole diameter or pattern on the template. This process eliminates possible charring of outer edges of the perforations by a thermal technique, e.g. laser, and also minimizes skin residue remaining on the surface from a thermal or mechanical perforating process. Minimal residue is desired so that the surface texture of the skin covering is kept smooth, thereby preventing toner particles from departing the image and adhering to a rougher skin surface.

Figure 4B:
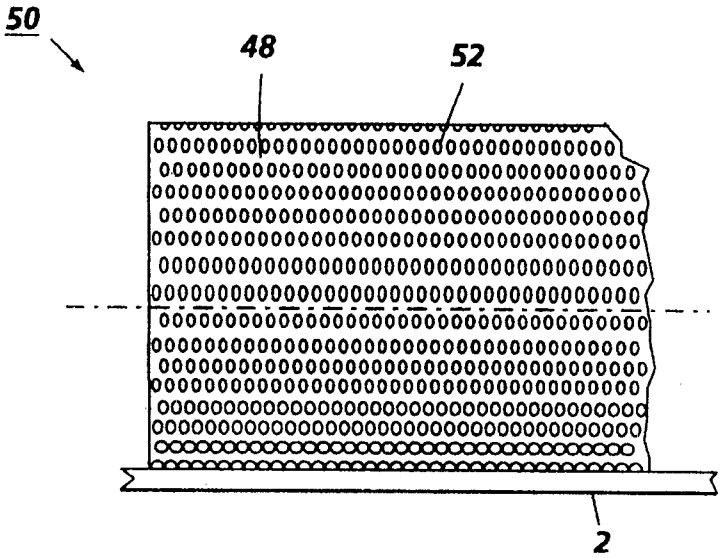
FIG. 4B is an enlarged front schematic elevational view of the FIG. 4A roller.
Figure 4A:
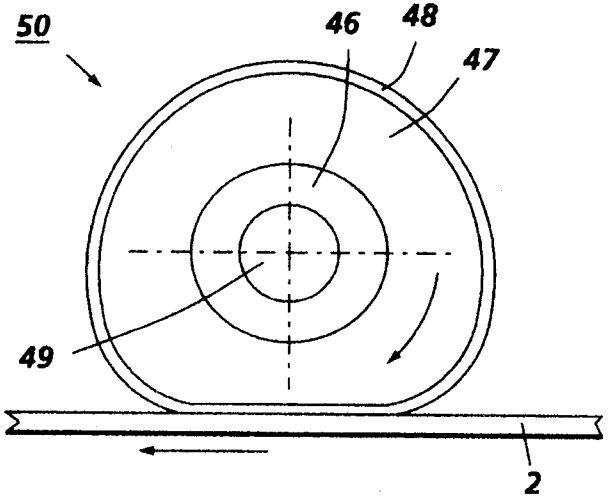
FIG. 4A is an enlarged side schematic elevational view of another embodiment of the FIG. 3A roller.

In systems where the blotter roller 50 may be compressed during the liquid carrier removal process, as illustrated in FIGS. 4A and 4B, the geometry of the perforations 52 through the skin covering 48 may be configured of a shape other than circular, so that a maximum amount of liquid may flow through the blotter roller during compression. Compression of the blotter roller may be a useful step for conditioning of the liquid developer image, whereby the rate of absorption is potentially increased, and the toner particles to the image are compacted, thereby reducing the pile height of the image.

Figure 5:
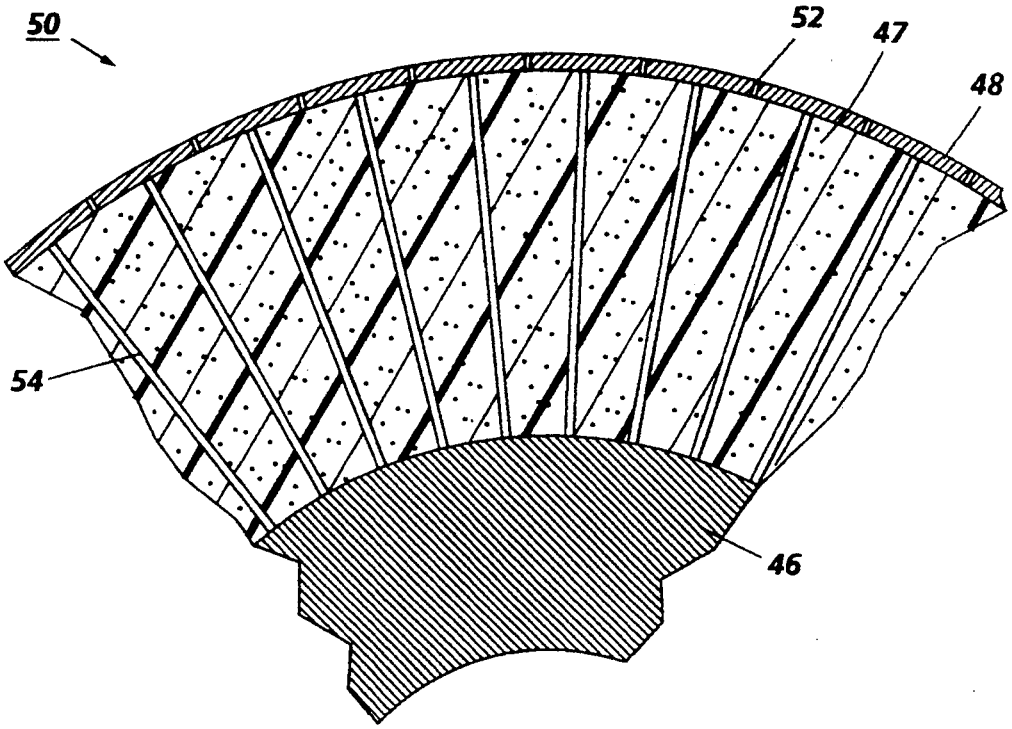
FIG. 5 is an enlarged schematic, sectional, elevational view of a portion of another embodiment of the FIG. 3A roller.

In another embodiment of the invention, and as illustrated by the enlarged, sectional view in FIG. 5 showing the relative proportional perforation diameters, apertures or perforations 54 are also formed as a separate process step through the conformable foam roller layer 47 using the aforementioned perforating processes and their equivalents. The size of the perforations formed through this foam layer 47 is not limited by the toner particle size, as is the size of the perforations 52 formed through the skin covering layer 48. For example, in this embodiment, while the skin covering perforations 52 average less than 15 microns in diameter, the perforations 54 formed through the conformable foam layer average 250 to 300 microns in diameter.

Figure 6:
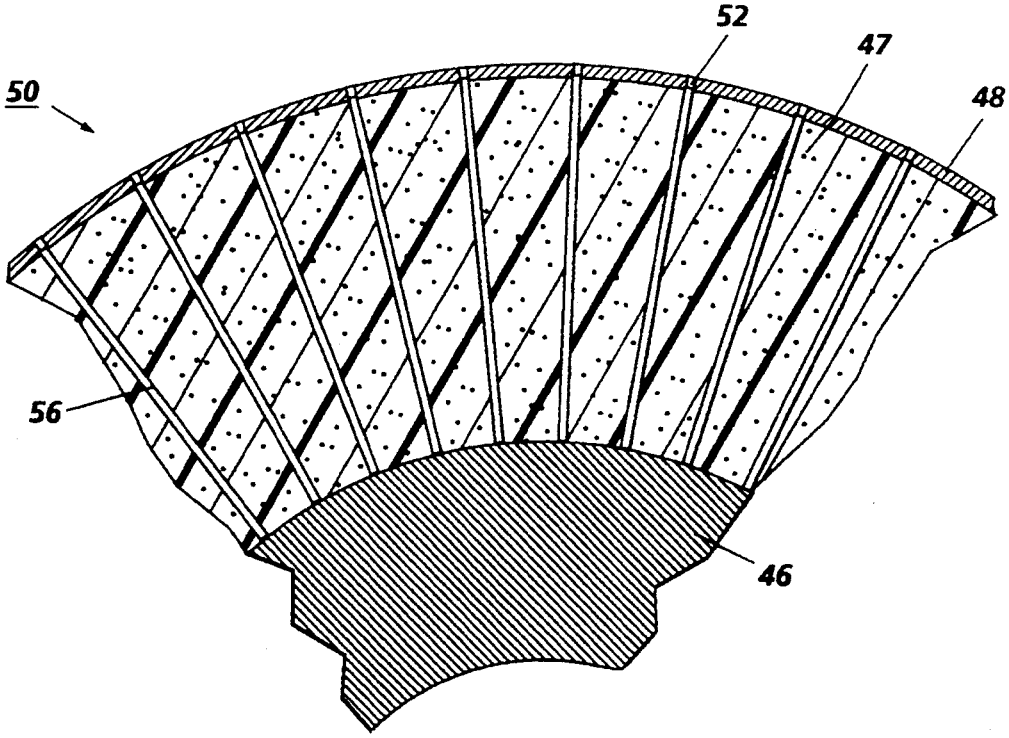
FIG. 6 is an enlarged schematic, sectional, elevational view of a portion of another embodiment of the FIG. 3A roller.

In still another embodiment of the invention, and as illustrated by an enlarged sectional view in FIG. 6 showing the perforation diameters, the perforations 56 are formed through the skin covering layer 48 and the conformable foam layer 47 in a single process step using the aforementioned perforating processes and their equivalents. In this embodiment, however, the perforation size through both layers is restricted by the toner particle size, so that toner is blocked from entering the roller. In this embodiment, for example, the perforations 56 through both the skin covering 48 and conformable foam layer 47 average less than 15 microns in diameter.

While the invention has been described with reference to particular preferred embodiments, the invention is not limited to the specific examples shown, and other embodiments and modifications can be made by those skilled in the art without departing from the spirit and scope of the invention and claims.

What is claimed is:

1. A roller for conditioning an image formed from a liquid developer including liquid carrier and toner particles, comprising:

an absorption material adapted to absorb the liquid carrier; and a covering in contact with a portion of said absorption material, said covering having a smooth surface and being substantially impervious to toner particles and pervious to liquid carrier to inhibit toner particles from departing the image, and having a plurality of perforations therein to permit liquid carrier to pass therethrough to said absorption material.

2. A roller as claimed in claim 1, wherein said absorption material defines a cavity.

3. A roller as claimed in claim 2, further comprising removal means for removing liquid carrier from said absorption material at substantially the same rate as absorption of the liquid carrier into said absorption material.

4. A roller as claimed in claim 3, wherein said removal means comprises a vacuum source in communication with the cavity of said absorption material to adjust the pressure wherein so that the rate of absorption of liquid carrier into said absorption material is substantially equal to the rate of removal of liquid carrier therefrom.

5. A roller as claimed in claim 1, wherein said absorption material comprises:

a rigid porous core; and a conformable open cell porous roller mounted around said core.

6. A roller as claimed in claim 5, wherein said rigid core is electroconductive, further comprising means for applying an electrical bias to the core to repel the toner particles, so as to further inhibit the toner particles from departing the image and entering said absorption material.

7. A roller as claimed in claim 6, wherein said conformable open cell porous roller has a resistivity in the range of about $10^{-5}$ ohm-cm to about $10^{-11}$ ohm-cm.

8. A roller as claimed in claim 1, wherein said covering is microporous.

9. A roller as claimed in claim 1, wherein said covering includes perforations ranging from about 1 micron to about 15 microns in diameter.

10. A roller as claimed in claim 1, wherein said covering includes perforations spaced from center to center of one another an average distance in the range of about 15 microns to about 30 microns.

11. A roller as claimed in claim 1, wherein said covering includes perforations shaped to maximize the rate of absorption of liquid carrier therethrough in response to the roller being compressed.

12. A roller as claimed in claim 5, wherein the perforations formed through said covering extend through said conformable roller.

13. A roller as claimed in claim 5, wherein said conformable roller includes a plurality of perforations therethrough.

14. A roller as claimed in claim 13, wherein said conformable roller includes perforations ranging from about 1 micron to about 300 microns in diameter.

15. A roller as claimed in claim 1, wherein said roller is in the form of a belt.

16. A printing machine of the type having a surface, with an image developed with a liquid developer comprising liquid carrier and toner particles, and a roller for removing liquid carrier therefrom before transferring the developed image from the surface to a final copy sheet, comprising:

an absorption material adapted to absorb the liquid carrier; and a covering in contact with a portion of said absorption material, said covering having a smooth surface and being substantially impervious to toner particles and pervious to liquid carrier to inhibit toner particles from departing the image, and having a plurality of perforations therein to permit liquid carrier to pass therethrough to said absorption material.

17. A printing machine as claimed in claim 16, wherein said absorption material defines a cavity.

18. A printing machine as claimed in claim 17, further comprising removal means for removing liquid carrier from said absorption material at substantially the same rate as absorption of the liquid carrier into said absorption material.

19. A printing machine as claimed in claim 17, wherein said removal means comprises a vacuum source in communication with the cavity of said absorption material to adjust the pressure therein so that the rate of absorption of liquid carrier into said absorption material is substantially equal to the rate of removal of liquid carrier therefrom.

20. A printing machine as claimed in claim 16, wherein said absorption material comprises:

a rigid porous core; and a conformable open cell porous roller mounted around said core.

21. A printing machine as claimed in claim 20, wherein said rigid core is electroconductive, further comprising means for applying an electrical bias to the core to repel the toner particles, so as to further inhibit the toner particles from departing the image and entering said absorption material.

22. A roller as claimed in claim 21, wherein said conformable open cell porous roller has a resistivity in the range of about $10^5$ −ohm-cm to about $10^{-11}$ ohm-cm.

23. A printing machine as claimed in claim 16, wherein said covering is microporous.

24. A printing machine as claimed in claim 16, wherein said covering includes perforations ranging from about 1 micron to about 15 microns in diameter.

25. A printing machine as claimed in claim 16, wherein said covering includes perforations spaced from center to center of one another an average distance in the range of about 15 microns to about 30 microns.

26. A printing machine as claimed in claim 16, wherein said covering includes perforations shaped to maximize the rate of absorption of liquid carrier therethrough in response to the roller being compressed.

27. A printing machine as claimed in claim 20, wherein the perforations formed through said covering extend through said conformable roller.

28. A printing machine as claimed in claim 20, wherein said conformable roller includes a plurality of perforations therethrough.

29. A printing machine as claimed in claim 28, wherein said conformable roller includes perforations ranging from about 1 micron to about 300 microns in diameter.

30. A method of fabricating a roller for conditioning an image formed from a liquid developer including liquid carrier and toner particles, comprising the steps of:

selecting a cover having a smooth glossy exterior surface and being substantially impervious to toner particles and pervious to liquid carrier to inhibit toner particles from departing the image;

perforating the cover with a plurality of apertures; and placing the cover and a portion of an absorption material in contact with one another.

31. A method as recited in claim 30, further comprising the step of shaping the absorption material to define a cavity.

32. A method of as recited in claim 30, further comprising the step of perforating the absorption material with a plurality of apertures before said placing step.

* * * * *